US012757984B2

(12) United States Patent
Luo

(10) Patent No.: US 12,757,984 B2
(45) Date of Patent: Oct. 13, 2026

(54) UMBRELLA CAPABLE OF BEING QUICKLY ASSEMBLED AND DISASSEMBLED

(71) Applicant: Tempo Manufacturing LLC, Nantong (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 174 days.

(21) Appl. No.: 18/785,767

(22) Filed: Jul. 26, 2024

(65) Prior Publication Data

US 2025/0031815 A1 Jan. 30, 2025

(30) Foreign Application Priority Data

Jul. 27, 2023 (CN) ..... 202310930454.8

(51) Int. Cl.
*A45B 25/02* (2006.01)
*A45B 25/06* (2006.01)

(52) U.S. Cl.
CPC ..... *A45B 25/02* (2013.01); *A45B 25/06* (2013.01)

(58) Field of Classification Search
CPC ..... A45B 25/02; A45B 25/04; A45B 25/06
USPC ..... 135/28, 30, 29
See application file for complete search history.

(56) References Cited

U.S. PATENT DOCUMENTS

| | | | | |
|---|---|---|---|---|
| 295,042 | A * | 3/1884 | Nial | A45B 25/02 135/33.41 |
| 1,535,993 | A * | 4/1925 | Garfinkel | A45B 25/02 135/29 |
| 4,201,237 | A * | 5/1980 | Watts | A45B 25/14 135/30 |
| 7,963,293 | B2 * | 6/2011 | Ma | A45B 25/14 135/37 |
| 9,271,551 | B2 * | 3/2016 | Ma | A45B 25/02 |
| 11,206,904 | B2 * | 12/2021 | Ma | A45B 25/02 |
| 2009/0056776 | A1 * | 3/2009 | Ma | A45B 25/02 135/29 |
| 2010/0059094 | A1 * | 3/2010 | Ma | A45B 25/02 135/28 |
| 2021/0298436 | A1 * | 9/2021 | Ma | A45B 25/10 |

* cited by examiner

*Primary Examiner* — Noah C. Hawk
(74) *Attorney, Agent, or Firm* — Wang Law Firm, Inc.

(57) ABSTRACT

An umbrella capable of being quickly assembled and disassembled has a column; a plurality of long rods; a plurality of short rods; an upper nest; a lower nest; a plurality of rod connectors; and a plurality of connecting mechanisms. Each long rod has a first end which is detachably connected to the upper nest through one rod connector, and each short rod has a first end which is detachably connected to the lower nest through one rod connector and a second end which is detachably connected to the middle portion of the corresponding long rod through one connecting mechanism. During disassembly, it is only necessary to disassemble the elastic connecting pins from the connecting mechanisms, and the long rods and the short rods can be quickly disassembled from the nests without using any tool.

6 Claims, 7 Drawing Sheets

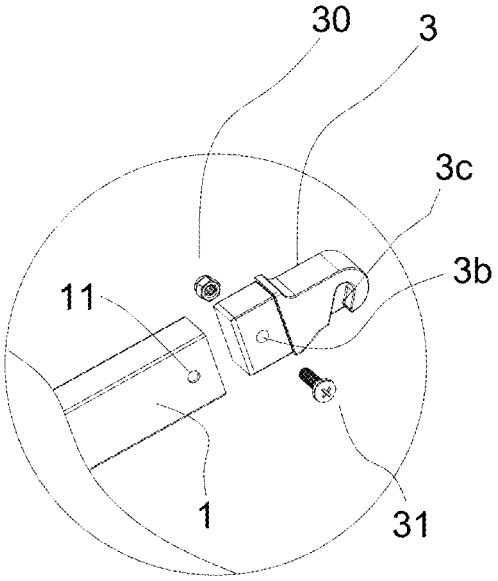
FIG.2.1
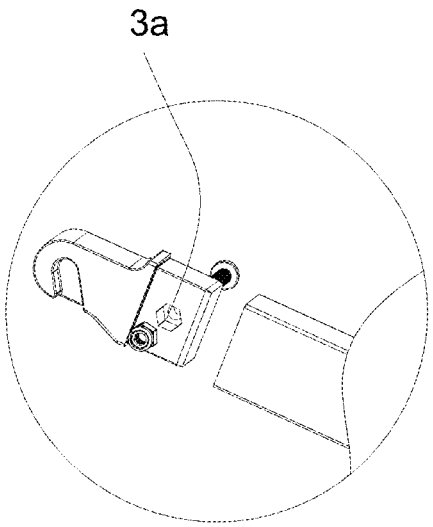
FIG.2.2
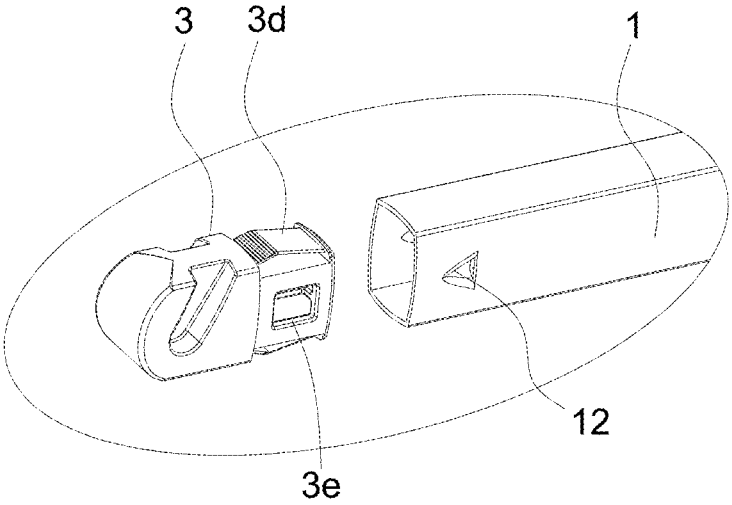
FIG.3

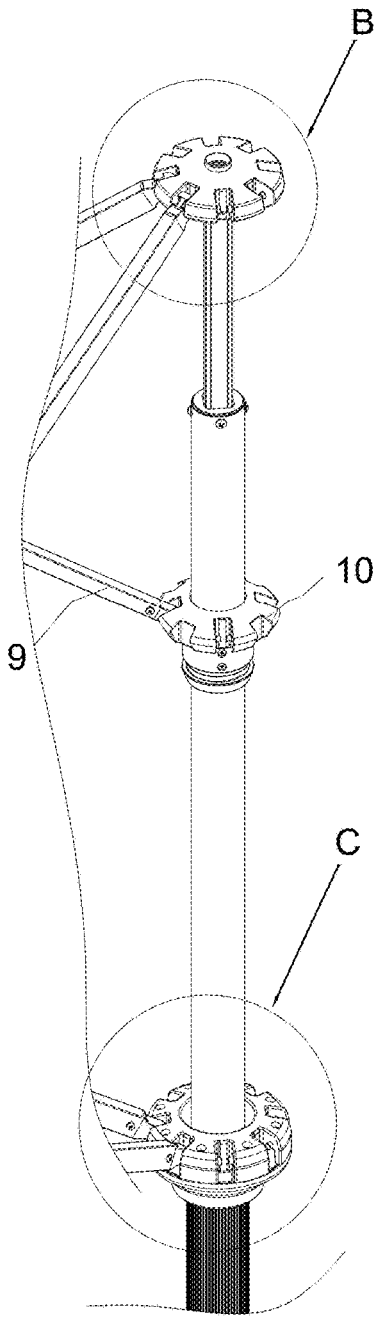
FIG.4
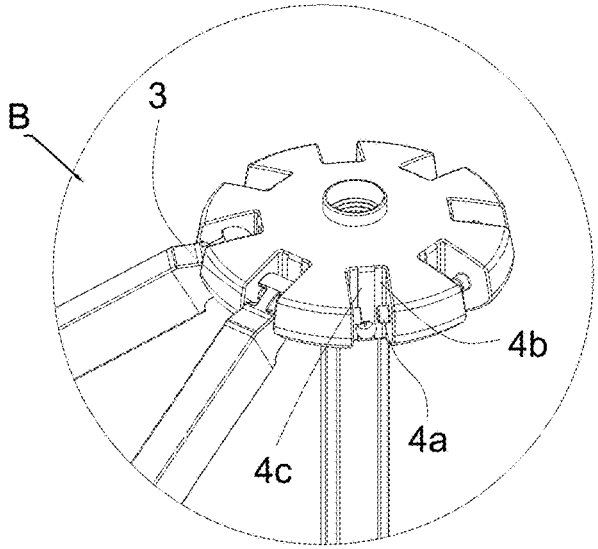
FIG.5.1
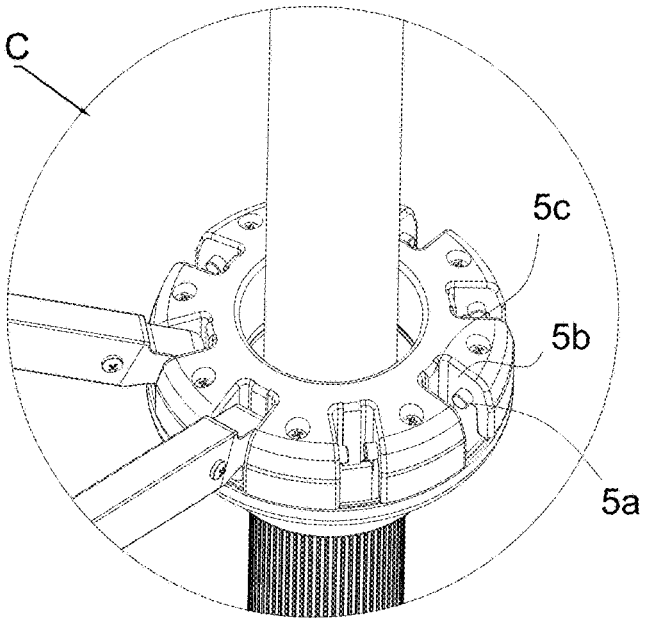
FIG.5.2

UMBRELLA CAPABLE OF BEING QUICKLY ASSEMBLED AND DISASSEMBLED

TECHNICAL FIELD OF THE INVENTION

The present invention relates to a field of umbrellas, and in particular to an umbrella capable of being quickly assembled and disassembled.

BACKGROUND OF THE INVENTION

As a kind of outdoor leisure items, umbrellas are widely applied in squares, beaches, parks, gardens or similar places to shield an individual from sun. Most umbrellas in the current market are inconvenient to assemble. A plurality of rods is connected to the umbrella nests by welding or through connecting members such as bolts or screws which are in combination with pads, so that disassembling process is complicated and some auxiliary tools will be used. Particularly for commercial-grade umbrellas, during replacement of some accessories, new accessories can be replaced only after the whole umbrella is disassembled. In addition, for most umbrellas in the market, the stand and the rods are made of aluminum or steel material. The aluminum material is high in cost; while the iron material is easy to rust, and the manufactured products are heavy in weight and high in transportation cost.

Upon examination, a Chinese Patent CN217117693U (patent No.: CN202220646838.8) discloses an umbrella frame mounting mechanism for a umbrella, comprising a nest, a plurality of connecting components and a plurality of connecting rods, wherein the plurality of connecting rods are disposed at regular intervals at a periphery of the nest; each connecting rod is detachably connected to the nest through the corresponding connecting component; each of the connecting components comprises a first connecting seat, a second connecting seat, a first connecting member and a plurality of connecting plates; the first connecting seat is connected to the nest, and the second connecting seat is connected to an end of the connecting rod; the first connecting seat has a connecting groove for receiving the second connecting seat; the second connecting seat has a groove for receiving the connecting plates on a side of the second connecting seat; the second connecting seat is inserted into the connecting groove so that the connecting plate is clamped between the connecting groove and an inner wall of the connecting groove; and, a first connecting member passes through a side of the connecting groove to be connected to the first connecting seat after the second connecting seat is inserted into the connecting groove. The rods of the umbrella are detachable and are also connected stably. However, it is not convenient and quick for assembling and disassembling. Therefore, this connecting mechanism of the umbrella needs to be further improved.

SUMMARY OF THE INVENTION

It is an object of the present invention to provide an umbrella capable of being quickly assembled and disassembled, which is simple and reasonable in structure and easy to operate.

For achieving the above object, the umbrella capable of being quickly assembled and disassembled comprises a column; a plurality of long rods each having a middle portion; a plurality of short rods; an upper nest; a lower nest; a plurality of rod connectors each having a rear end and a front end; a plurality of connecting mechanisms; wherein, each long rod has a first end which is detachably connected to the upper nest through one rod connector, and each short rod has a first end which is detachably connected to the lower nest through one rod connector and a second end which is detachably connected to the middle portion of the corresponding long rod through one connecting mechanism; each of the upper nest and the lower nest has a plurality of connecting grooves formed at intervals on a periphery of the upper nest and the lower nest, each connecting groove is for receiving one rod connector and has two inner walls, each of the upper nest and the lower nest has a plurality of pairs of connecting pins each pair protruding from two inner walls of the corresponding connecting groove; the rear end of each rod connector is connected to one long rod or one short rod, each rod connector has two sliding grooves respectively formed at a left side and a right side of the front end of each rod connector for receiving the pair of connecting pins, each sliding groove is distributed inclined and has an opening; when the front end of each rod connector is inserted into the corresponding connecting groove of the upper nest or the lower nest at a certain angle, each pair of connecting pins is capable of inserting into the corresponding two sliding grooves passing through the corresponding openings after rotating the rod connector, so as to make the rod connector quickly connect to the upper nest and the lower nest.

As an improvement, each long rod and short rod has an inner hole for the rear end of each rod connector to be inserted into, and the front end of each rod connector is positioned inside the corresponding connecting groove of the upper nest and the lower nest; the opening of each sliding groove is located at a top end of the sliding groove and a bottom end of each sliding groove is inclined forward, when the front end of each rod connector connected to the long rod is inserted into the corresponding connecting groove of the upper nest from a lower portion of the corresponding connecting groove, the opening of each sliding groove faces upward, under the rotation of the rod connector, each pair of connecting pins inserts into the corresponding two sliding grooves, so that the rod connector quickly connects to the upper nest; when the front end of each rod connector connected to the short rod is inserted into the corresponding connecting groove of the lower nest from an upper portion of the corresponding connecting groove, the opening of each sliding groove faces downward, under the rotation of the rod connector, each pair of connecting pins inserts into the corresponding two sliding grooves, so that the rod connector quickly connects to the lower nest.

Preferably, the rod connector has a retaining edge at the left side and the right side of the inner wall of the rod connector, respectively.

Preferably, the detailed connecting structure of the rod connector with the rod is: each rod connector has a nut groove at a left side of the rear end of the rod connector, and a bolt hole communicated with the nut groove at a right side of the rear end of the rod connector, a nut is embedded in the nut groove, each rod has a corresponding thorough nut hole at the first end of the rod; during mounting, the rear end of the rod connector is connected to the first end of the rod, a bolt passes through the nut hole on the rod and the bolt hole on the rod connector to screw the corresponding nut; or, the rod connector has an elastic sheet and a fixation groove formed at the rear end of the rod connector, a bump matched with the fixation groove protrudes inward from a side of the first end of the rod in a press-fitting manner; during mounting, the rear end of the rod connector is connected to the first end of the rod, the rod connector is connected to the rod due to the elasticity of the clastic sheet, and the connection of the rod connector with the rod are reinforced when the fixation groove receives the bump.

Preferably, the elastic sheet and the fixation groove are located adjacent to the rear end of the rod connector.

Preferably, the connecting mechanism between the long rod and the short rod comprises a connecting member having a U-shaped upper portion for receiving the long rod and a lower portion, the long rod has a plurality of connecting holes on the middle portion of the long rod, the U-shaped upper portion has corresponding thorough holes on a bottom of the U-shaped upper portion, the middle portion of the long rod is clamped within the U-shaped upper portion of the connecting member, the long rod is connected to the connecting member through rivets, the short rod has a connecting thorough hole at the second end of the short rod, the lower portion of the connecting member is a U-shaped connecting groove for receiving the second end of the short rod, the U-shaped connecting groove has a hole formed on two sides of the U-shaped connecting groove, respectively, the connecting member is detachably connected to the short rod through an elastic pin by passing through the hole and the connecting thorough hole.

Preferably, the connecting structure between the connecting member and the long rod is a buckling connection manner as follows: the U-shaped upper portion of the connecting member has a buckle with certain elasticity on each side of the U-shaped upper portion, the long rod has a corresponding fixation groove formed at the middle portion of the long rod, the middle portion of the long rod is clamped within the U-shaped upper portion and connected in an inverted buckling manner through the buckle connecting with the fixation groove.

Preferably, the connecting mechanism between the short rod and the long rod is as follows: the long rod has a via hole formed at the middle portion of the long rod, the short rod has a corresponding connecting via hole formed at the second end of the short rod, an clastic pin passes through the via hole and the connecting via hole to detachably connect the short rod with the long rod.

Preferably, the connecting mechanism between the short rod and the long rod comprises a foldable clastic connecting member having a left connecting plate, a right connecting plate and a top plate, the left connecting plate and the right connecting plate are integrally connected together through the top plate, a U-shaped connecting clamping strip with internal teeth protrudes from an inner wall of the left connecting plate, a connecting block with external teeth protrudes from an inner wall of the right connecting plate; after the left connecting plate and the right connecting plate are folded in an inverted buckling manner, the connecting block is inserted into the U-shaped connecting clamping strip, at this time, the internal teeth of the connecting block are engaged with the external teeth of the connecting block; after the left connecting plate and the right connecting plate are folded in an inverted buckling manner, the connecting block is inserted into the U-shaped connecting clamping strip, at this time, the internal teeth of the connecting block are engaged with the external teeth of the connecting block; the left connecting plate and the right connecting plate of the elastic connecting member has a via formed on a lower portion, the clastic connecting member is detachably connected to the short rod through an elastic pin.

Preferably, the clastic pin has an inverted cone-shaped fixation step at a top end of the clastic pin and an clastic groove formed axially at the top end of the clastic pin, the top end of the clastic groove is divided into a left part and a right part by the clastic groove.

Finally, the column, the long rods and the short rods are all made of carbon fiber.

Compared with the prior art, the umbrella capable of being quickly assembled and disassembled of the present invention has the following advantages. The first end of each long rod and the short rod are detachably connected to the upper nest and the lower nest, respectively. The second end of each short rod is detachably connected to the middle portion of the corresponding long rod. During disassembling, it is only necessary to disassemble the clastic connecting pins from the connecting mechanisms, and the long rods and the short rods can be quickly disassembled from the nests without using any tool, so that quick assembly of the umbrella and accessory replacement can be ensured. The umbrella capable of being quickly assembled and disassembled of the present invention is simple and reasonable in structure and easy to operate, and can be quickly disassembled and assembled by one person, so that the labor cost is greatly reduced, the weight of the umbrella is reduced, and the transportation cost is reduced.

BRIEF DESCRIPTION OF THE DRAWINGS

FIGS. 2.1-2.2 are two exploded views of a rod connector and a rod according to Embodiment 1 of the present invention showing how they are mounted together;

FIG. 3 is an exploded view of a rod connector and a rod according to Embodiment 2 of the present invention;

FIG. 4 is a perspective view of the rods and nests according to Embodiment 1 of the present invention;

FIG. 5.1 is an enlarged view of a Part-B in the FIG. 4 and FIG. 5.2 is an enlarged view of a Part-C in FIG. 4;

DETAILED DESCRIPTION OF THE INVENTION

Figure 1:
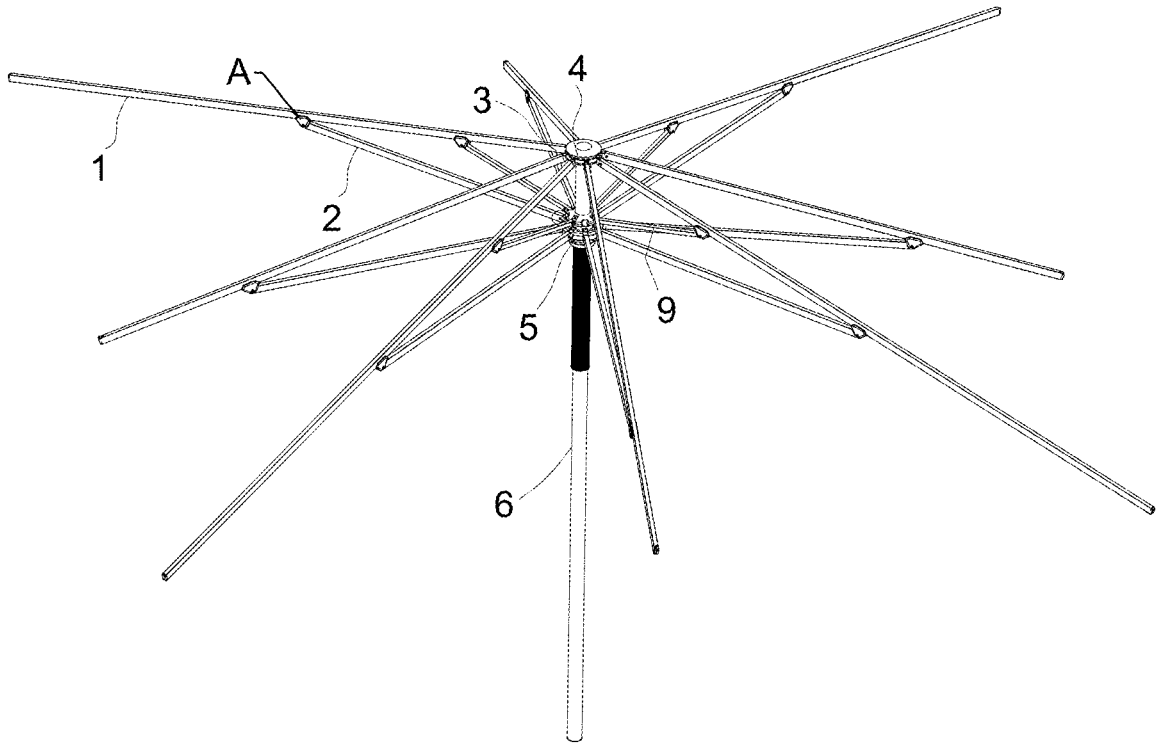
FIG. 1 is a perspective view of an umbrella according to Embodiment 1 of the present invention.

The present invention will be further described below in detail by embodiments with reference to the accompanying drawings.

Embodiment 1

As shown in FIGS. 1-5.2, an umbrella capable of being quickly assembled and disassembled comprises a column 6;

a plurality of long rods 1 each having a middle portion; a plurality of short rods 2; an upper nest 4; a lower nest 5; a plurality of rod connectors 3 each having a rear end and a front end; a plurality of connecting mechanisms A; wherein, each long rod 1 has a first end which is detachably connected to the upper nest 4 through one rod connector 3, and each short rod 2 has a first end which is detachably connected to the lower nest 5 through one rod connector 3 and a second end which is detachably connected to the middle portion of the corresponding long rod 1 through one connecting mechanism A; each of the upper nest 4 and the lower nest 5 has a plurality of connecting grooves 4*b*, 5*b* formed at intervals on a periphery of the upper nest 4 and the lower nest 5, each connecting groove 4*b*, 5*b* is for receiving one rod connector 3 and has two inner walls, each of the upper nest 4 and the lower nest 5 has a plurality of pairs of connecting pins 4*a*, 5*a* each pair protruding from two inner walls of the corresponding connecting groove 4*b*, 5*b*; the rear end of each rod connector 3 is connected to one long rod 1 or one short rod 2, each rod connector 3 has two sliding grooves 3*c* respectively formed at a left side and a right side of the front end of each rod connector 3 for receiving the pair of connecting pins 4*a*, 5*a*, each sliding groove 3*c* is distributed inclined and has an opening; when the front end of each rod connector 3 is inserted into the corresponding connecting groove 4*b*, 5*b* of the upper nest 4 or the lower nest 5 at a certain angle, each pair of connecting pins 4*a*, 5*a* is capable of inserting into the corresponding two sliding grooves 3*c* passing through the corresponding openings after rotating the rod connector 3, so as to make the rod connector 3 quickly connect to the upper nest 4 and the lower nest 5.

Figure 6:
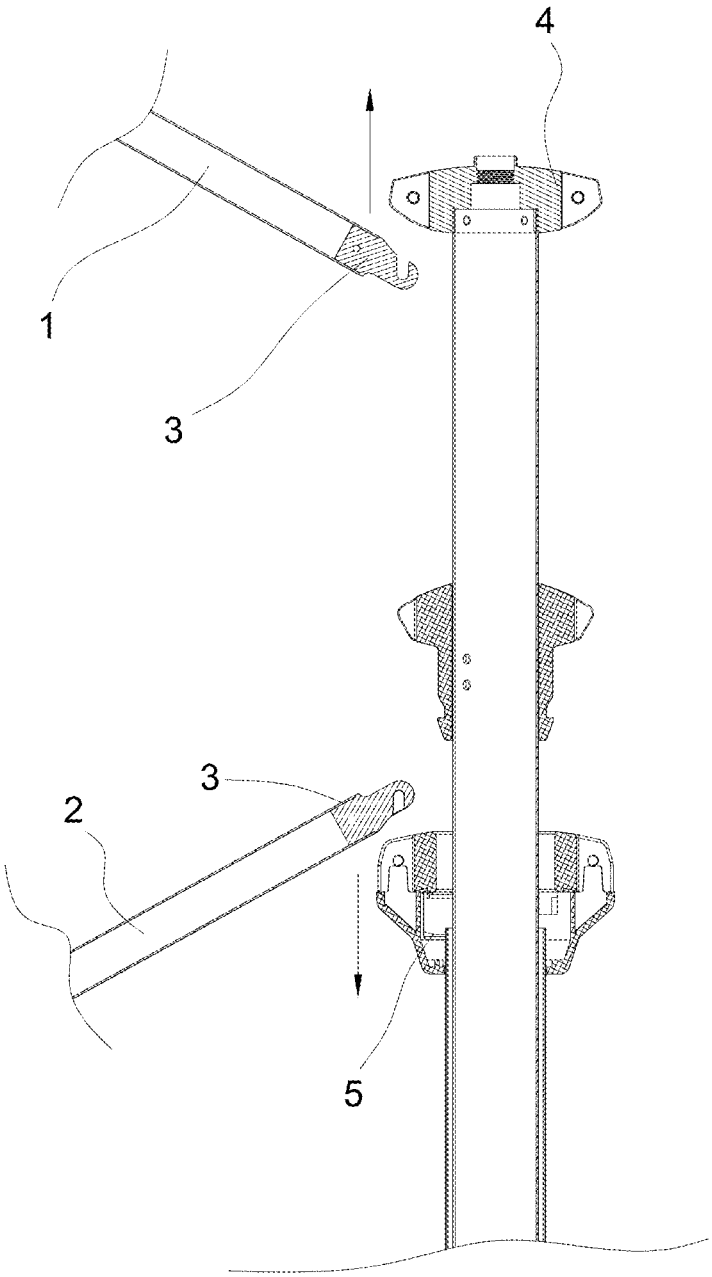
FIG. 6 is a sectional view of the rods and the nests according to Embodiment 1 of the present invention showing how they are connected.
Figure 7:
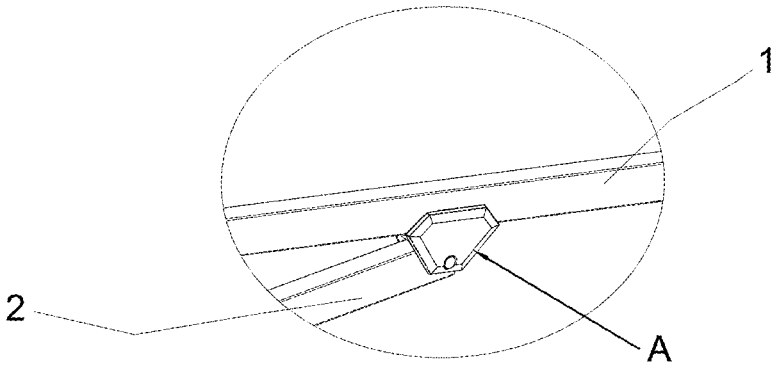
FIG. 7 is an enlarged view of a junction between a long rod and a short rod according to Embodiment 1 of the present invention.
Figure 8:
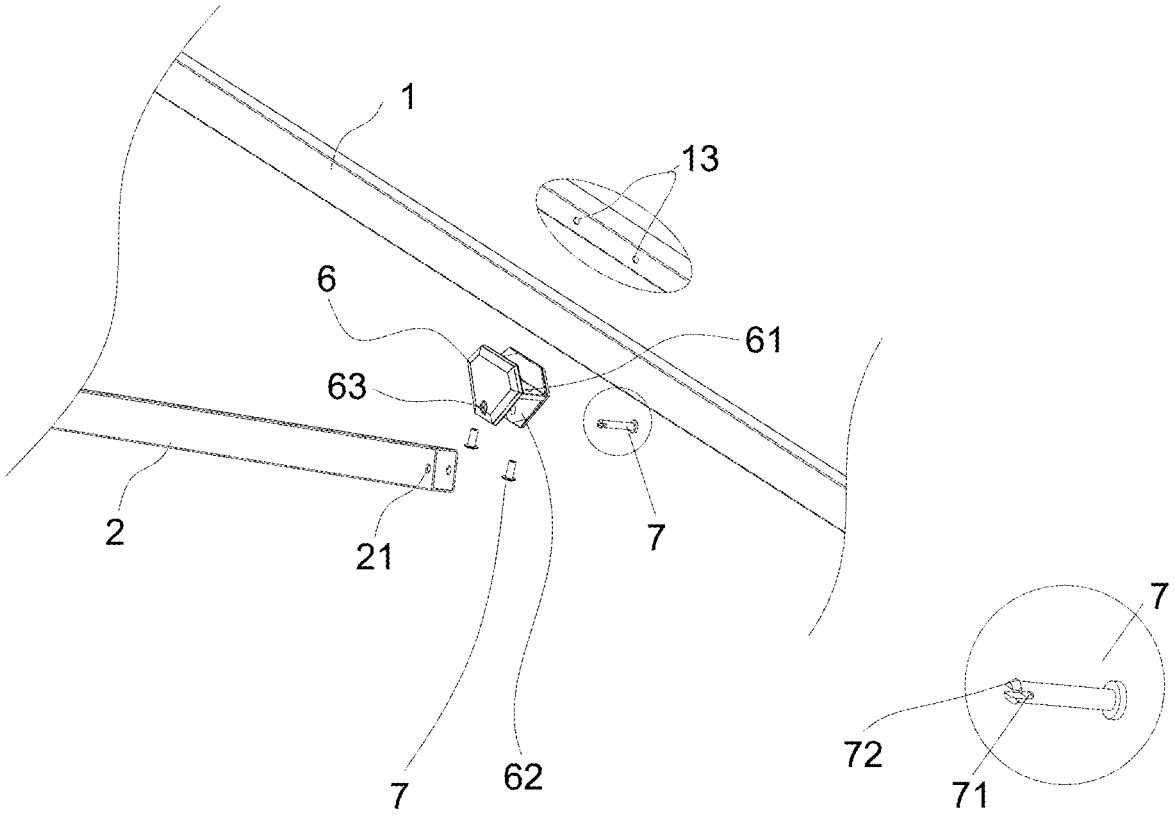
FIG. 8 is an exploded view of FIG. 7.

Specifically, each rod connector 3 has two sections (that is the rear end and the front end), each long rod 1 and short rod 2 has an inner hole for the rear end of each rod connector 3 to insert into, and the front end of each rod connector 3 is positioned inside the corresponding connecting groove 4*b*, 5*b* of the upper nest 4 and the lower nest 5; the opening of each sliding groove 3*c* is located at a top end of the sliding groove 3*c* and a bottom end of each sliding groove 3*c* is inclined forward, as shown in FIG. 6, when the front end of each rod connector 3 connected to the long rod 1 is inserted into the corresponding connecting groove 4*b* of the upper nest 4 from a lower portion of the corresponding connecting groove 4*b*, the opening of each sliding groove 3*c* faces upward, under the rotation of the rod connector 3, each pair of connecting pins 4*a* inserts into the corresponding two sliding grooves 3*c*, so that the rod connector 3 quickly connects to the upper nest 4; when the front end of each rod connector 3 connected to the short rod s is inserted into the corresponding connecting groove 5*b* of the lower nest 5 from an upper portion of the corresponding connecting groove 5*b*, the opening of each sliding groove 3*c* faces downward, under the rotation of the rod connector 3, each pair of connecting pins 5*a* inserts into the corresponding two sliding grooves 3*c*, so that the rod connector 3 quickly connects to the lower nest 5. The rod connector 3 has a retaining edge 4*c*, 5*c* at the left side and the right side of the inner wall of the rod connector 3, respectively.

The detail connecting structure of the rod connector 3 with the rod is: as shown in FIG. 2, each rod connector 3 has a nut groove 3*a* at a left side of the rear end of the rod connector 3, and a bolt hole 3*b* communicated with the nut groove 3*a* at a right side of the rear end of the rod connector 3, a nut 30 is embedded in the nut groove 3*a*, each long rod 1 has a corresponding thorough nut hole 11 at the first end of the long rod 1; during mounting, the rear end of the rod connector 3 is connected to the first end of the rod, a bolt 31 passes through the nut hole 11 on the long rod 1 and the bolt hole 3*b* on the rod connector 3 to screw the corresponding nut 30. The connecting structure between the rod connector 3 and the short rod 2 is the same as that between the rod connector 3 and the long rod 1.

The connecting mechanism A between the long rod 1 and the short rod 2 comprises a connecting member 6 having a U-shaped upper portion for receiving the long rod 1 and a lower portion, the long rod 1 has two connecting holes 13 on the middle portion of the long rod 1, the U-shaped upper portion has corresponding two thorough holes 61 on a bottom of the U-shaped upper portion, the middle portion of the long rod 1 is clamped within the U-shaped upper portion of the connecting member 6, the long rod 1 is connected to the connecting member 6 through rivets, the short rod 2 has a connecting thorough hole 21 at the second end of the short rod 2, the lower portion of the connecting member 6 is a U-shaped connecting groove 62 for receiving the second end of the short rod 2, the U-shaped connecting groove 62 has a hole 63 formed on two sides of the U-shaped connecting groove 62, respectively, the connecting member 6 is detachably connected to the short rod 2 through an elastic pin 7 by passing through the hole 63 and the connecting thorough hole 21. The elastic pin 7 has an inverted cone-shaped fixation step 72 at a top end of the elastic pin 7 and an elastic groove 71 formed axially at the top end of the elastic pin 7, the top end of the elastic groove 71 is divided into a left part and a right part by the elastic groove 71, so that the quick disassembling of the umbrella can be ensured.

During mounting, the first end of each long rod 1 and short rod 2 are connected to one rod connector 3, and the connecting member 6 is riveted on the middle portion of each long rod 1. The front end of each rod connector 3 being connected to the long rod 1 is inserted into the corresponding connecting groove 4*b* of the upper nest 4 at a certain angle. Each pair of connecting pins 4*a* of the upper nest 4 is capable of inserting into the corresponding two sliding grooves 3*c*, and each long rod 1 is rotated clockwise so that the plurality of long rods 1 tend to be perpendicular to the upper nest 4. The front end of each rod connector 3 being connected to the short rod 1 is inserted into the corresponding connecting groove 5*b* of the lower nest 5 at a certain angle. Each pair of connecting pins 5*a* of the lower nest 5 is capable of inserting into the corresponding two sliding grooves 3*c*, and each short rod 2 is rotated clockwise so that the plurality of short rods 2 tend to be perpendicular to the lower nest 5.

Finally, each short rod 2 is inserted into the U-shaped connecting groove 62 of the corresponding connecting member 6, and each short rod 2 is detachably connected to the corresponding long rod 1 through elastic pins 7.

In order to reduce the weight of the umbrella, in this embodiment, the column 6, the long rods 1 and the short rods 2 are all made of carbon fiber, which has the characteristic of resistance to rust of aluminum and the characteristic of light weight of carbon fiber, so that the cost for transportation can be greatly reduced and the grade of the product can be improved.

For an outdoor umbrella with a large umbrella canopy, in addition to the plurality of long rods 1 and the short rods 2, a plurality of reinforcing rods 9 may also be arranged. A middle nest 10 is additionally disposed between the upper nest 4 and the lower nest 5, and the middle nest 10 is fixed on the column 6. Each reinforcing rod 9 has a first end to be detachably connected to the middle nest 10, and a second end to be detachably connected to the corresponding long rod 1 through the connecting mechanism. The connection mechanism A between each reinforcing rod 9 and the middle nest 10 is also the rod connector 3, and the connecting structure between each reinforcing rod 9 and the corresponding long rod 1 is the same as that between each short rod 2 and the corresponding long rod 1.

Embodiment 2

As shown in FIG. 3, the umbrella capable of being quickly assembled and disassembled in this embodiment differs from that in Embodiment 1 in a connecting structure between the rod connector 3 and the rods. The detail is as below: the rod connector 3 has an elastic sheet 3*d* and a fixation groove 3*e* formed at the rear end of the rod connector 3, a bump 12 matched with the fixation groove 3*e* protrudes inward from a side of the first end of the rod in a press-fitting manner; during mounting, the rear end of the rod connector 3 is connected to first top end of the rod, the rod connector 3 is connected to the rod due to the elasticity of the elastic sheet 3*d*, and the connection of the rod connector 3 with the rod are reinforced when the fixation groove 3*e* receives the bump 12. The connecting structure between each rod connector 3 and the corresponding short rod 2 is the same as that between each rod connector 3 and the corresponding long rod 1.

The elastic sheet 3*d* and the fixation groove 3*e* are located adjacent to the rear end of the rod connector 3.

Embodiment 3

Figure 9:
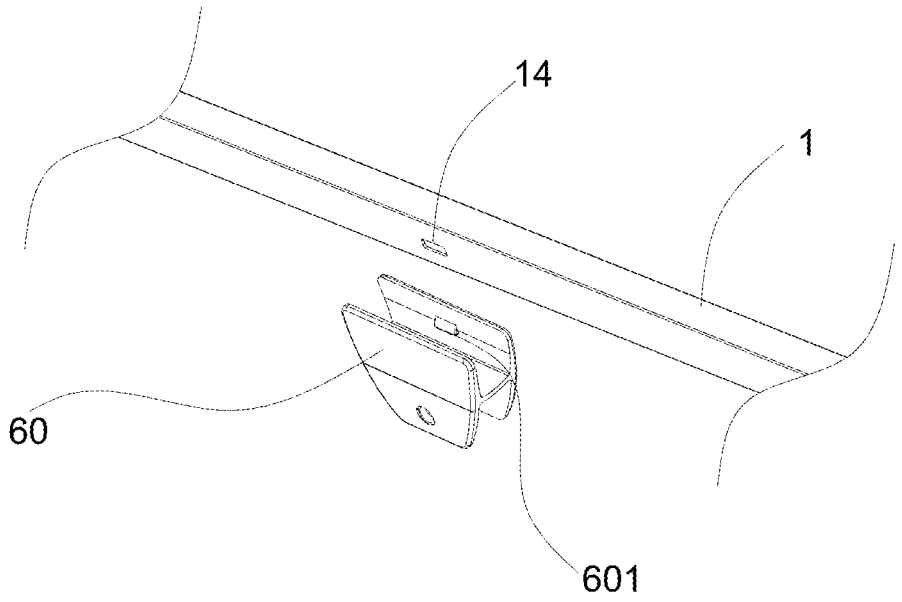
FIG. 9 is an exploded view of a connecting mechanism and a long rod according to Embodiment 3 of the present invention.

As shown in FIG. 9, the umbrella capable of being quickly assembled and disassembled in this embodiment differs from that in Embodiment 1 in that: the connecting structure between the connecting member 60 and the long rod 1 is a buckling connection manner as follows: the U-shaped upper portion of the connecting member 60 has a buckle 601 with certain elasticity on each side of the U-shaped upper portion, the long rod 1 has a corresponding fixation groove 14 formed at the middle portion of the long rod 1, the middle portion of the long rod 1 is clamped within the U-shaped upper portion and connected in an inverted buckling manner through the buckle 601 connecting with the fixation groove 14.

Embodiment 4

Figure 10:
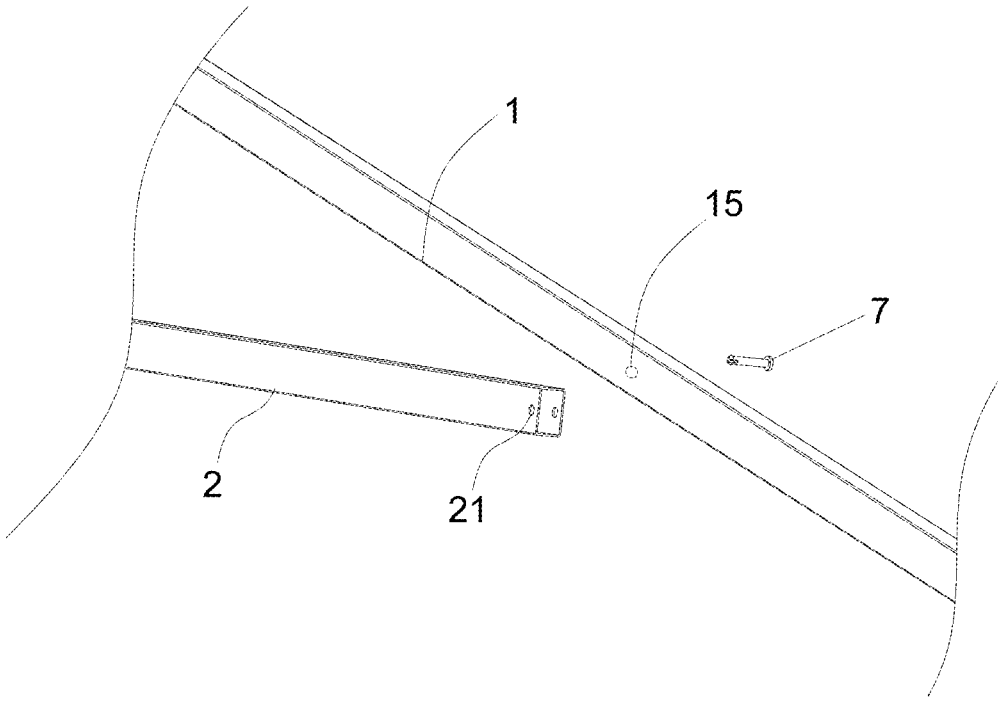
FIG. 10 is an exploded view of a long rod and a short rod according to Embodiment 4 of the present invention showing how they are connected.

As shown in FIG. 10, the umbrella capable of being quickly assembled and disassembled in this embodiment differs from that in Embodiment 1 in the connecting mechanism A between each short rod 2 and the corresponding long rod 1. Specifically, the connecting mechanism A between the short rod 2 and the long rod 1 is as follows: the long rod 1 has a via hole 15 formed at the middle portion of the long rod 1, the short rod 2 has a corresponding connecting via hole 21 formed at the second end of the short rod 2, an elastic pin 7 passes through the via hole 15 and the connecting via hole 21 to detachably connect the short rod 2 with the long rod 1.

Embodiment 5

Figure 11:
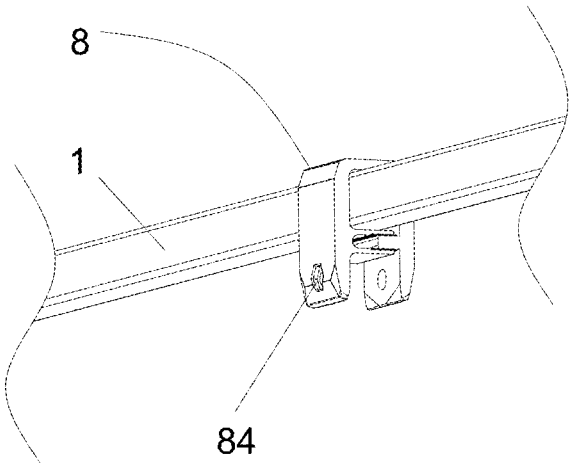
FIG. 11 is a perspective view of a connecting mechanism and a long rod according to Embodiment 5 of the present invention when they are mounted together.
Figure 12:
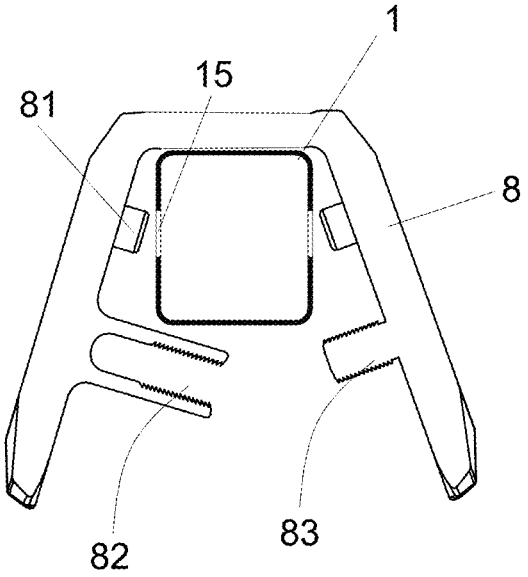
FIG. 12 is a front view of an elastic connecting member according to Embodiment 5 of the present invention when it is in an unfolded state.
Figure 13:
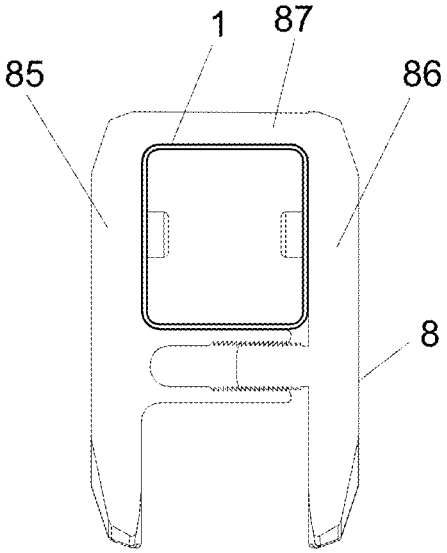
FIG. 13 is a front view of the elastic connecting member according to Embodiment 5 of the present invention when it is in a folded state.

As shown in FIGS. 11, 12 and 13, the umbrella capable of being quickly assembled and disassembled in this embodiment differs from that in Embodiment 1 in the connecting mechanism A between each short rod 2 and the corresponding long rod 1. Specifically, the connecting mechanism A between the short rod 2 and the long rod 1 comprises a foldable elastic connecting member 8 having a left connecting plate 85, a right connecting plate 86 and a top plate 87, the left connecting plate 85 and the right connecting plate 86 are integrally connected together through the top plate 87, a U-shaped connecting clamping strip 82 with internal teeth protrudes from an inner wall of the left connecting plate 85, a connecting block 83 with external teeth protrudes from an inner wall of the right connecting plate 86; after the left connecting plate 85 and the right connecting plate 85 are folded in an inverted buckling manner, the connecting block 83 is inserted into the U-shaped connecting clamping strip 82, at this time, the internal teeth of the connecting block 83 are engaged with the external teeth of the connecting block 83; a shaft pin 81 is respectively disposed on the inner wall of the left connecting plate 85 and the right connecting plate 86, the long rod 1 has a shaft pin through hole 15 for receiving corresponding shaft pin 81 at a left side and a right side of the long rod 1, respectively, the middle portion of the long rod 1 is arranged within the elastic connecting member 8 and limited by buckling each shaft pin 81 into the corresponding shaft pin connecting hole 15, and then fixed by the connection of the left connecting plate 85 and the right connecting plate 86; the left connecting plate 85 and the right connecting plate 85 of the elastic connecting member 8 has a via 84 formed on a lower portion, the elastic connecting member 8 is detachably connected to the short rod 2 through an elastic pin 7.

The protection scope of the present invention is not limited to each embodiment described in this description. Any changes and replacements made on the basis of the scope of the present invention patent and of the description shall be included in the scope of the present invention patent.

The invention claimed is:

1. An umbrella capable of being quickly assembled and disassembled, comprising:

a column;

a plurality of long rods each having a middle portion;

a plurality of short rods;

an upper nest;

a lower nest;

a plurality of rod connectors each having a rear end and a front end;

a plurality of connecting mechanisms;

wherein, each long rod has a first end which is detachably connected to the upper nest through one rod connector, and each short rod has a first end which is detachably connected to the lower nest through one rod connector and a second end which is detachably connected to the middle portion of the corresponding long rod through one connecting mechanism;

each of the upper nest and the lower nest has a plurality of connecting grooves formed at intervals on a periphery of the upper nest and the lower nest, each connecting groove is for receiving one rod connector and has two inner walls, each of the upper nest and the lower nest has a plurality of pairs of connecting pins each pair protruding from two inner walls of the corresponding connecting groove;

the rear end of each rod connector is connected to one long rod or one short rod, each rod connector has two sliding grooves respectively formed at a left side and a right side of the front end of each rod connector for receiving the pair of connecting pins, each sliding groove is distributed inclined and has an opening;

when the front end of each rod connector is inserted into the corresponding connecting groove of the upper nest or the lower nest at a certain angle, each pair of connecting pins is capable of inserting into the corresponding two sliding grooves passing through the corresponding openings after rotating the rod connector, so as to make the rod connector quickly connect to the upper nest and the lower nest;

the connecting mechanism between the long rod and the short rod comprises a connecting member having a U-shaped upper portion for receiving the long rod and a lower portion, the long rod has a plurality of connecting holes on the middle portion of the long rod, the U-shaped upper portion has corresponding thorough holes on a bottom of the U-shaped upper portion, the middle portion of the long rod is clamped within the U-shaped upper portion of the connecting member, the long rod is connected to the connecting member through rivets, the short rod has a connecting thorough hole at the second end of the short rod, the lower portion of the connecting member is a U-shaped connecting groove for receiving the second end of the short rod, the U-shaped connecting groove has a hole formed on two sides of the U-shaped connecting groove, respectively, the connecting member is detachably connected to the short rod through an elastic pin by passing through the hole and the connecting thorough hole; and the elastic pin has an inverted cone-shaped fixation step at a top end of the elastic pin and an elastic groove formed axially at the top end of the elastic pin, the top end of the elastic groove is divided into a left part and a right part by the elastic groove.

2. The umbrella of claim 1, wherein each long rod and short rod has an inner hole for the rear end of each rod connector to be inserted into, and the front end of each rod connector is positioned inside the corresponding connecting groove of the upper nest and the lower nest;

the opening of each sliding groove is located at a top end of the sliding groove and a bottom end of each sliding groove is inclined forward, when the front end of each rod connector connected to the long rod is inserted into the corresponding connecting groove of the upper nest from a lower portion of the corresponding connecting groove, the opening of each sliding groove faces upward, under the rotation of the rod connector, each pair of connecting pins inserts into the corresponding two sliding grooves, so that the rod connector quickly connects to the upper nest;

when the front end of each rod connector connected to the short rod is inserted into the corresponding connecting groove of the lower nest from an upper portion of the corresponding connecting groove, the opening of each sliding groove faces downward, under the rotation of the rod connector, each pair of connecting pins inserts into the corresponding two sliding grooves, so that the rod connector quickly connects to the lower nest.

3. The umbrella of claim 2, wherein the rod connector has a retaining edge at the left side and the right side of the inner wall of the rod connector, respectively.

4. The umbrella of claim 2, wherein the detailed connecting structure of the rod connector with the rod is: each rod connector has a nut groove at a left side of the rear end of the rod connector, and a bolt hole communicated with the nut groove at a right side of the rear end of the rod connector, a nut is embedded in the nut groove, each rod has a corresponding thorough nut hole at the first end of the rod;

during mounting, the rear end of the rod connector is connected to the first end of the rod, a bolt passes through the nut hole on the rod and the bolt hole on the rod connector to screw the corresponding nut;

or, the rod connector has an elastic sheet and a fixation groove formed at the rear end of the rod connector, a bump matched with the fixation groove protrudes inward from a side of the first end of the rod in a press-fitting manner;

during mounting, the rear end of the rod connector is connected to the top end of the rod, the rod connector is connected to the rod due to the elasticity of the elastic sheet, and the connection of the rod connector with the rod are reinforced when the fixation groove receives the bump.

5. The umbrella of claim 4, wherein the elastic sheet and the fixation groove are located adjacent to the rear end of the rod connector.

6. The umbrella of claim 1, wherein the column, the long rods and the short rods are all made of carbon fiber.

* * * * *